US010638219B2

(12) United States Patent
Pan et al.

(10) Patent No.: US 10,638,219 B2
(45) Date of Patent: Apr. 28, 2020

(54) DIFFUSER AND LOUDSPEAKER

(71) Applicant: Wistron Corporation, New Taipei (TW)

(72) Inventors: Li-Ping Pan, New Taipei (TW); Ta-Yuan Tai, New Taipei (TW); Jian-Zong Lee, New Taipei (TW); I-Chun Wu, New Taipei (TW); Ching-Fu Hsu, New Taipei (TW); Cheng-Hsing Liu, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/192,804

(22) Filed: Nov. 16, 2018

(65) Prior Publication Data

US 2020/0053454 A1 Feb. 13, 2020

(30) Foreign Application Priority Data

Aug. 9, 2018 (TW) ..... 107127781 A

(51) Int. Cl.
*H04R 7/12* (2006.01)
*H04R 1/34* (2006.01)

(52) U.S. Cl.
CPC ..... *H04R 1/345* (2013.01); *H04R 7/127* (2013.01)

(58) Field of Classification Search
CPC ..... H04R 1/345; H04R 7/127
See application file for complete search history.

(56) References Cited

U.S. PATENT DOCUMENTS

| | | | | |
|---|---|---|---|---|
| 4,348,549 | A | 9/1982 | Berlant | |
| 5,173,942 | A * | 12/1992 | Hirose | H04R 1/345 181/155 |
| 5,268,538 | A | 12/1993 | Queen | |
| 6,996,243 | B2 * | 2/2006 | Welker | H04R 1/02 381/160 |
| 2004/0231911 | A1 * | 11/2004 | Welker | H04R 1/26 181/165 |

FOREIGN PATENT DOCUMENTS

| | | | |
|---|---|---|---|
| CN | 201608889 | 10/2010 | |
| DE | 19546898 | 6/1997 | |
| DE | 10341213 A1 * | 4/2005 | H04R 1/345 |
| WO | 2018022087 | 2/2018 | |

OTHER PUBLICATIONS

"Search Report of Europe Counterpart Application", dated Jul. 16, 2019, p. 1-p. 9.

* cited by examiner

*Primary Examiner* — Brian Ensey
(74) *Attorney, Agent, or Firm* — JCIPRNET

(57) ABSTRACT

A diffuser includes a cone body including an apex portion, a bottom portion, and a side edge portion. The apex portion forms a partial spherical surface, and the side edge portion is aspherical and is connected between the apex portion and the bottom portion. The apex portion satisfies: $2R/3 \leq r \leq R$, where r is a radius of curvature of the apex portion, and R is a radius of curvature of a spherical diaphragm of a tweeter speaker. A loudspeaker including a tweeter speaker and a diffuser is also provided.

21 Claims, 9 Drawing Sheets

DIFFUSER AND LOUDSPEAKER

CROSS-REFERENCE TO RELATED APPLICATION

This application claims the priority benefit of Taiwan application serial no. 107127781, filed on Aug. 9, 2018. The entirety of the above-mentioned patent application is hereby incorporated by reference herein and made a part of this specification.

BACKGROUND

Technical Field

The disclosure relates to a diffuser and a loudspeaker, particularly, a diffuser and a loudspeaker used for sound diffusion.

Description of Related Art

The speaker monomers are mainly designed to produce sound from the front side. Nevertheless, transmission of sound with higher frequencies (e.g., frequencies greater than 8 KHz) usually decreases as deviation from the axis direction of the front side of the speaker monomer. Sound produced by the speaker monomer is thereby distorted, and clarity of the sound is also reduced. In order to overcome the foregoing problems, multiple speaker monomers may be disposed on multiple sides, or sound directions of the speaker monomers may be arranged to be vertically (relative to the ground) disposed. Nevertheless, high manufacturing costs are required if multiple speaker monomers are to be disposed, and overall volume of the multiple speaker monomers are great, and sound performance of sound with higher frequencies may still not be effectively improved in the case of the sound directions of the speaker monomers are vertically disposed.

The information disclosed in this "Description of Related Art" section is only for enhancement of understanding of the content of the disclosure and therefore it may contain information that does not form the related art that is already known to people having ordinary skills in the art. Further, the information disclosed in the "Description of Related Art" section does not mean that one or more problems to be resolved by one or more embodiments of the disclosure was acknowledged by people having ordinary skill in the art.

SUMMARY

The disclosure provides a diffuser configured to provide a sound diffusion effect of a tweeter speaker.

The disclosure further provides a loudspeaker featuring a favorable sound effect.

A diffuser in an embodiment of the disclosure includes a cone body including an apex portion, a bottom portion, and a side edge portion. The apex portion forms a partial spherical surface, and the bottom portion and the apex portion are located at two opposite sides of the cone body. The side edge portion is aspherical and is connected between the apex portion and the bottom portion. The apex portion satisfies: $2R/3 \geq r \geq R$, where r is a radius of curvature of the apex portion, and R is a radius of curvature of a spherical diaphragm of a tweeter speaker.

In an embodiment of the disclosure, in the diffuser, a central axis is defined by connecting an apex of the apex portion to a center of curvature of the apex portion, and the central axis extends and passes through a geometric center of the bottom portion.

In an embodiment of the disclosure, in the diffuser, a distance between an apex of the apex portion and the bottom portion is 20 mm to 40 mm.

In an embodiment of the disclosure, in the diffuser, a first connection line is defined by connecting a connection point between the apex portion and the side edge portion to a center of curvature of the apex portion, and a second connection line is defined by connecting the apex of the apex portion to the center of curvature of the apex portion. An included angle θ between the first connection line and the second connection line satisfies: $30° \geq \theta \geq 45°$.

In an embodiment of the disclosure, in the diffuser, a slope of the side edge portion with respect to the bottom portion decreases away from the apex portion.

In an embodiment of the disclosure, the diffuser further includes at least one support pillar inserted on the side edge portion, and the at least one support pillar protrudes and extends from the side edge portion away from the bottom portion.

In an embodiment of the disclosure, in the diffuser, the at least one support pillar has a first through hole, and the cone body has a second through hole. The first through hole is connected to the second through hole.

A loudspeaker provided by an embodiment of the disclosure includes a tweeter speaker and a diffuser. The tweeter speaker has a spherical diaphragm, and a radius of curvature of the spherical diaphragm is R. The diffuser is disposed above the tweeter speaker and is separated from the tweeter speaker. The diffuser includes an apex portion, a bottom portion, and a side edge portion. The apex portion faces towards the tweeter speaker, and the apex portion forms a partial spherical surface. A radius of curvature of the apex portion is r, and $2R/3 \geq r \geq R$. The bottom portion is separated from the apex portion by a distance. The side edge portion is aspherical and is connected between the apex portion and the bottom portion.

In an embodiment of the disclosure, in the loudspeaker, a central axis is defined by connecting an apex of the apex portion to a center of curvature of the apex portion. The central axis extends and passes through a zenith of the spherical diaphragm of the tweeter speaker.

In an embodiment of the disclosure, in the loudspeaker, a distance between an apex of the diffuser and a zenith of the spherical diaphragm is less than or equal to 5 mm and greater than or equal to 0.5 mm.

In an embodiment of the disclosure, in the loudspeaker, a vertical distance between the bottom portion of the cone body and a zenith of the spherical diaphragm of the tweeter speaker is 20.5 mm to 45 mm.

In an embodiment of the disclosure, in the loudspeaker, a first connection line is defined by connecting a connection point between the apex portion and the side edge portion to a center of curvature of the apex portion, and a second connection line is defined by connecting the apex of the apex portion to the center of curvature of the apex portion. An included angle θ between the first connection line and the second connection line satisfies: $30° \geq \theta \geq 45°$.

In an embodiment of the disclosure, in the loudspeaker, a slope of the side edge portion of the diffuser with respect to the bottom portion of the diffuser decreases away from the apex portion.

In an embodiment of the disclosure, in the loudspeaker, the diffuser further includes at least one support pillar inserted on the side edge portion, and the at least one support pillar protrudes and extends from the side edge portion away from the bottom portion.

In an embodiment of the disclosure, in the loudspeaker, the at least one support pillar has a first through hole, and the cone body has a second through hole. The first through hole is connected to the second through hole.

In an embodiment of the disclosure, the loudspeaker further includes a carrier, the tweeter speaker is installed on the carrier, and the carrier exposes the spherical diaphragm of the tweeter speaker.

In an embodiment of the disclosure, in the loudspeaker, a cross-sectional width of the carrier is 4 times to 5 times greater than a cross-sectional width of the spherical diaphragm of the tweeter speaker.

In an embodiment of the disclosure, in the loudspeaker, a surface of the carrier is an arc surface.

In an embodiment of the disclosure, in the loudspeaker, the surface of the carrier is further away from a tangential plane of a zenith of the spherical diaphragm when being further away from the spherical diaphragm of the tweeter speaker.

In an embodiment of the disclosure, in the loudspeaker, the side edge portion forms an arc-shaped profile between the bottom portion and the apex portion. A radius of curvature of the arc-shaped profile is 65% of a cross-sectional width of the bottom portion.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
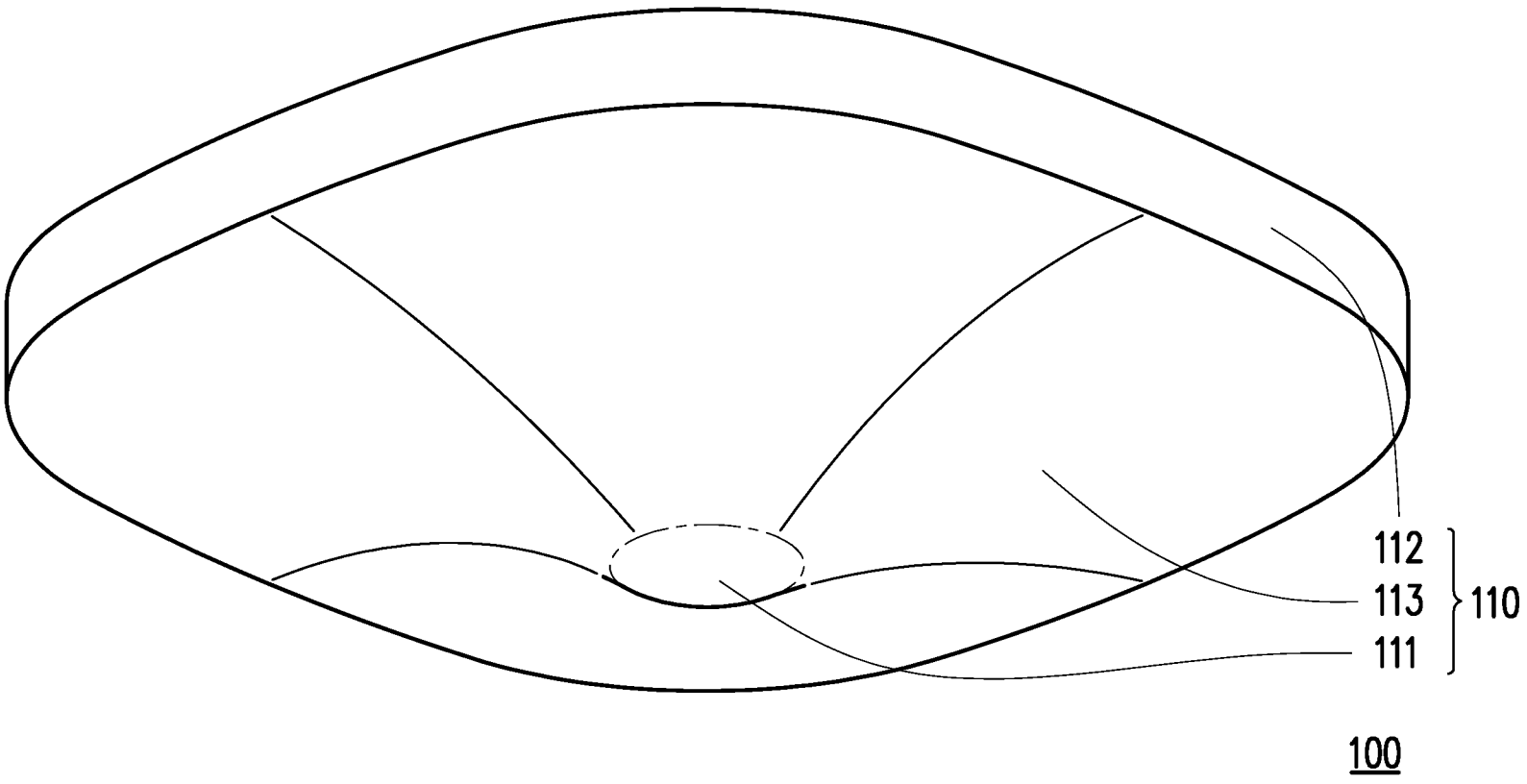
FIG. 1A is a schematic three-dimensional view of a diffuser according to an embodiment of the disclosure.
Figure 1B:
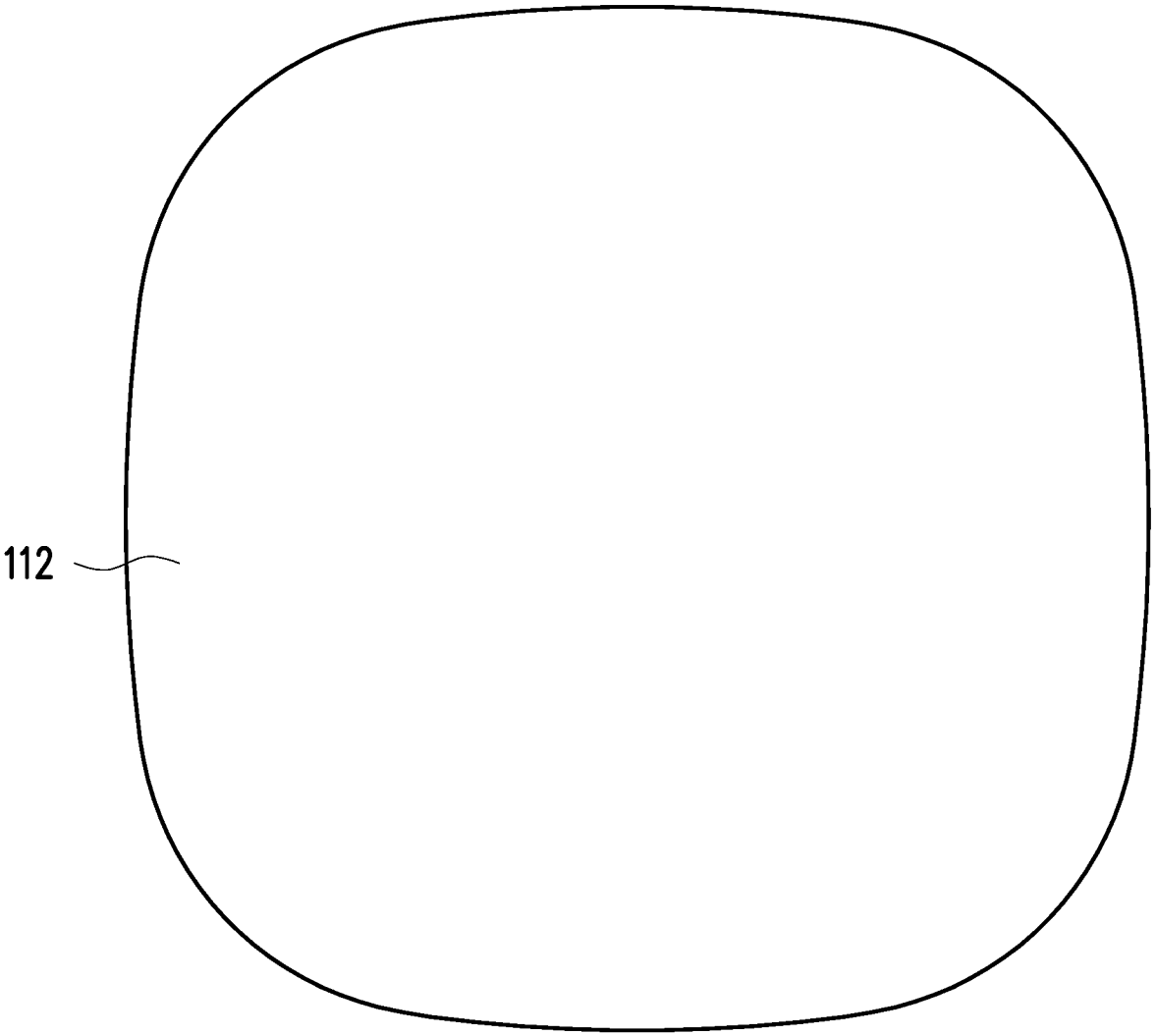
FIG. 1B is a schematic top view of the diffuser of FIG. 1A.
Figure 1C:
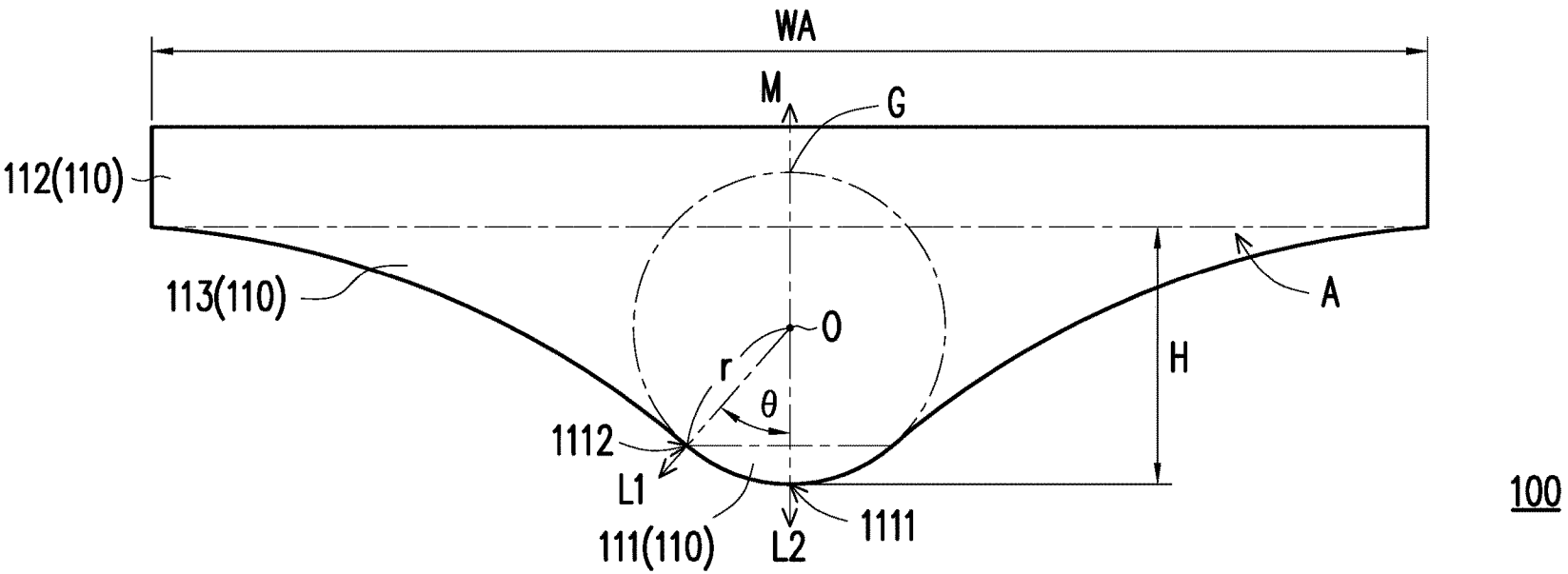
FIG. 1C is a schematic side view of the diffuser of FIG. 1A.

FIG. 1A is a schematic three-dimensional view of a diffuser 100 according to an embodiment of the disclosure, FIG. 1B is a schematic top view of the diffuser 100 of FIG. 1A, and FIG. 1C is a schematic side view of the diffuser 100 of FIG. 1A. With reference to FIG. 1A to FIG. 1C, the diffuser 100 of this embodiment includes a cone body 110, and the cone body includes an apex portion 111, a bottom portion 112, and a side edge portion 113. The apex portion 111 forms a partial spherical surface, and the bottom portion 112 and the apex portion 111 are located at two opposite sides of the cone body 110. The side edge portion 113 is aspherical and is connected between the apex portion 111 and the bottom portion 112. The diffuser 100 may be configured to be used with a tweeter speaker having a spherical diaphragm to provide a sound diffusion effect. Herein, the apex portion 111 of the diffuser 100 may be disposed to face towards the spherical diaphragm of the matched tweeter speaker. Moreover, the apex portion 111 may satisfy: $2R/3 \geq r \geq R$, where r is a radius of curvature of the apex portion 111, and R is a radius of curvature of the spherical diaphragm of the matched tweeter speaker. The diffuser 100 of this embodiment may be made of metal, plastic, wood, or other materials, but the disclosure is not intended to limit the materials used to make the diffuser 100.

In the diffuser 100 featuring the foregoing characteristics, a frequency response of sound waves with a higher frequency may be properly increased, as such, a response curve is relatively flat, and favorable sound quality is thereby achieved. The response curve is a curve presenting a sound producing effect of the loudspeaker with frequency (unit: Hz) as the horizontal axis and sound pressure (unit: dB) as the vertical axis. As regards the response curve, the loudspeaker is generally placed at a height of approximately 1 meter to 1.5 meters above the ground. A microphone is placed 1 meter away from the loudspeaker and is placed at a position as high as the loudspeaker. A result obtained by measuring sound produced by the loudspeaker in an anechoic chamber is the response curve. In general, the response curve may reflect accuracy of a reproduced sound frequency of the loudspeaker, and a flatter response curve may more faithfully reflect the sound frequency to be produced.

In the cone body 110 of the diffuser 100, the side edge portion 113 may be designed to be an aspherical structure, and the apex portion 111 may be designed to be a spherical structure. A connection point 1112 between the apex portion 111 and the side edge portion 113 may be regarded as a border defining the spherical structure and the aspherical structure. In addition, the bottom portion 112 is substantially a portion having a greatest cross-sectional area in the cone body 110, and a border between the bottom portion 112 and the side edge portion 113 may be defined by a plane A. The bottom portion 112 depicted in FIG. 1A to FIG. 1C has a thickness, but the thickness of the bottom portion 112 may be adjusted according to different needs. In some embodiments, the thickness of the bottom portion 112 may be relatively thin, so that the bottom portion 112 may be formed mainly by the plane A. Besides, in a top view, the bottom portion 112 may be shaped as any geometric shapes such as a circle, a square, a hexagon, an octagon, and other polygonal shapes. In the case of the bottom portion 112 being polygonal, corners of the bottom portion 112 may be round corners, but are not limited thereto. In the schematic views of FIG. 1A and FIG. 1B, a profile of the bottom portion 112 of this embodiment is exemplified as a square having rounded corners, but is not limited thereto.

The cone body 110 of the diffuser 100 may be designed to be a rotation symmetric structure. A central axis M defined by connecting an apex 1111 of the apex portion 111 to a center of curvature O of the apex portion 111 is a symmetric axis of the cone body 110. Further, the central axis M also extends and passes through a geometric center G of the bottom portion 112, as such, the cone body 110 is shaped as a rotation symmetric structure with respect to the central axis M. Through the rotation symmetric design, the diffuser 100 of this embodiment may achieve an evenly-dispersed sound diffusion effect in different directions. That is, the sound diffusion effect provided by the diffuser 100 is all-directional and is not limited to a specific direction.

In some embodiments, a distance H between the apex 1111 of the apex portion 111 and the bottom portion 112 may be, for example, 200 mm (millimeter) to 40 mm. Herein, the distance H between the apex 1111 of the apex portion 111 and the bottom portion 112 refers to a vertical distance between the apex 1111 and the plane A where the bottom portion 112 and the side edge portion 113 are connected. A diffusion effect of sound waves with a high frequency (e.g., greater than 8 KHz) may be increased by increasing the distance H. Nevertheless, volume of the diffuser 100 may also increase along with an increase in distance H, so that a compact volume design is not achieved. Hence, a designer may decide a structure and a size of the cone body 110 according to different needs and considerations.

From FIG. 1A and FIG. 1C, it can be seen that a width of the bottom portion 112 of the cone body 110 is greater, and a width of the side edge portion 113 gradually increases from the apex portion 111 towards the bottom portion 112 to form the cone body 110. In some embodiments, a first connection line L1 is defined by connecting a connection point 1112 between the apex portion 111 and the side edge portion 113 to the center of curvature O of the apex portion 111, and a second connection line L2 is defined by connecting the apex 1111 of the apex portion 111 to the center of curvature O of the apex portion 111. Further, an included angle θ between the first connection line L1 and the second connection line L2 may satisfy: $30° \geq \theta \geq 45°$. That is, the apex portion 111 may form a partial spherical surface with a radius r and an arc angle range of 60° to 90°. Besides, in a periphery of the connection point 1112, a slope of the side edge portion 113 with respect to the bottom portion 112 may be approximately 30° to 45°. Further, the slope of the side edge portion 113 with respect to the bottom portion 112 may decrease away from the apex portion 111, so as to appropriately lower an overall height of the diffuser 100. Nevertheless, along with different design needs, the slope of the side edge portion 113 with respect to the bottom portion 112 may selectively increase, maintain to be equal, or change segment by segment away from the apex portion 111. For instance, in an exemplary embodiment, when the side edge portion 113 is arc-shaped, the distance H between the apex 1111 of the apex portion 111 and the bottom portion 112 may be 36.4 mm, and a cross-sectional width WA of the bottom portion 112 may be 215.3 mm. In addition, when the side edge portion 113 is arc-shaped, from the side view of FIG. 1C, it can be seen that a radius of curvature of an arc-shaped profile formed between the apex portion 111 and the bottom portion 112 at the side edge portion 113 may be 65% of the cross-sectional width WA of the bottom portion 112. Part of the contents and components of the following embodiments are similar to that of the foregoing embodiments, and thereby, the same reference numerals are used in the two embodiments to represent identical or similar elements, and description of the same technical contents are also omitted in the following embodiments. Please refer to the descriptions of the previous embodiments for the omitted contents, which will not be repeated hereinafter.

Figure 2:
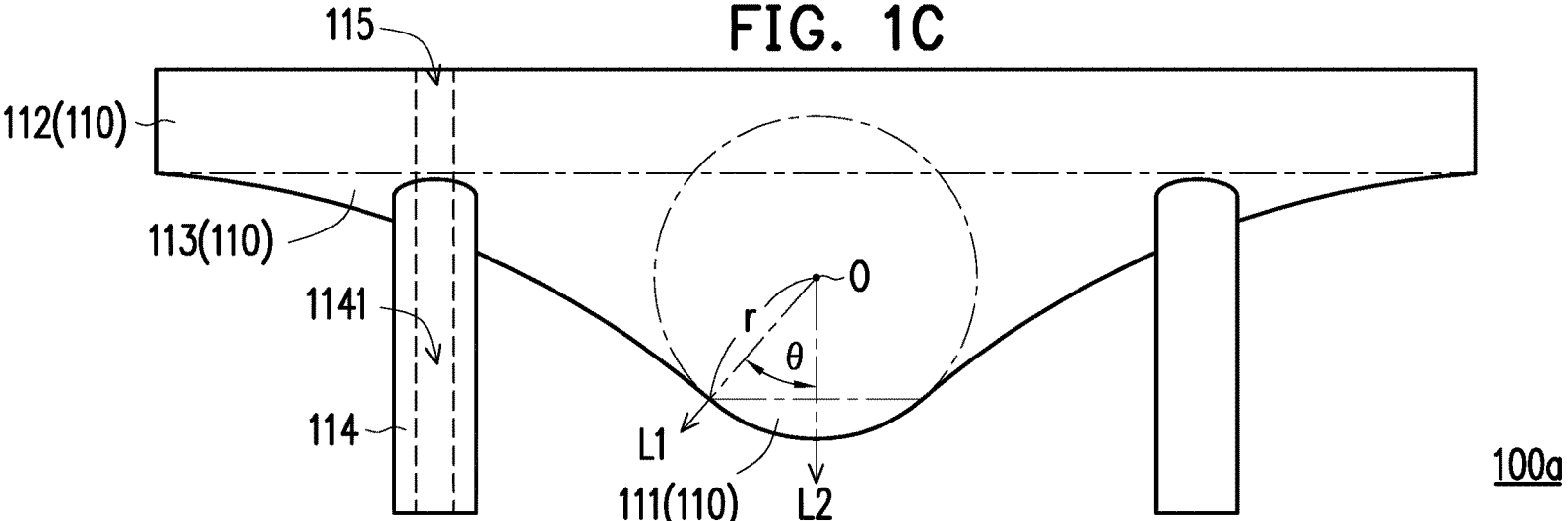
FIG. 2 is a schematic side view of a diffuser according to another embodiment of the disclosure.

FIG. 2 is a schematic side view of a diffuser 100*a* according to another embodiment of the disclosure. With reference to FIG. 2, the diffuser 100*a* of this embodiment is similar to the diffuser 100 of FIG. 1A to FIG. 1C, and a difference therebetween is that the diffuser 100*a* of this embodiment further includes at least one support pillar 114. The support pillar 114 is inserted on the side edge portion 113 and protrudes and extends from the side edge portion 113 away from the bottom portion 112. In this way, the diffuser 100*a* may conveniently correspond to other devices to be disposed or installed. The at least one support pillar 114 may include a first through hole 1141, and the cone body 110 may include a second through hole 115. Further, the first through hole 1141 and the second through hole 115 are connected, so as to provide a wiring space. In addition, in a top view, cross sections of the first through hole 1141 and the second through hole 115 may be teardrop-shaped, so that an electric wire may be conveniently inserted, but the disclosure is not intended to limit the shapes of the through holes. In a manufacturing and assembling process, the support pillar 114 and the cone body 110 may be individually manufactured or may be integrally-formed, and the disclosure is not limited thereto. Besides, the foregoing is merely an exemplary illustration of the first through hole 1141 and the second through hole 115, and in other embodiments including a diffuser with a support pillar, the support pillar and the cone body may both be solid structures and include no through hole disposed therein. In addition, since the diffuser 100*a* is suited to diffuse sound, a width of the support pillar 114 may be less than ¼ of a wavelength (approximately 1.7 cm) of a 20 KHz sound wave. In this way, sound transmission is not affected by the installation of the support pillar 114, but the disclosure is not limited thereto.

Figure 3:
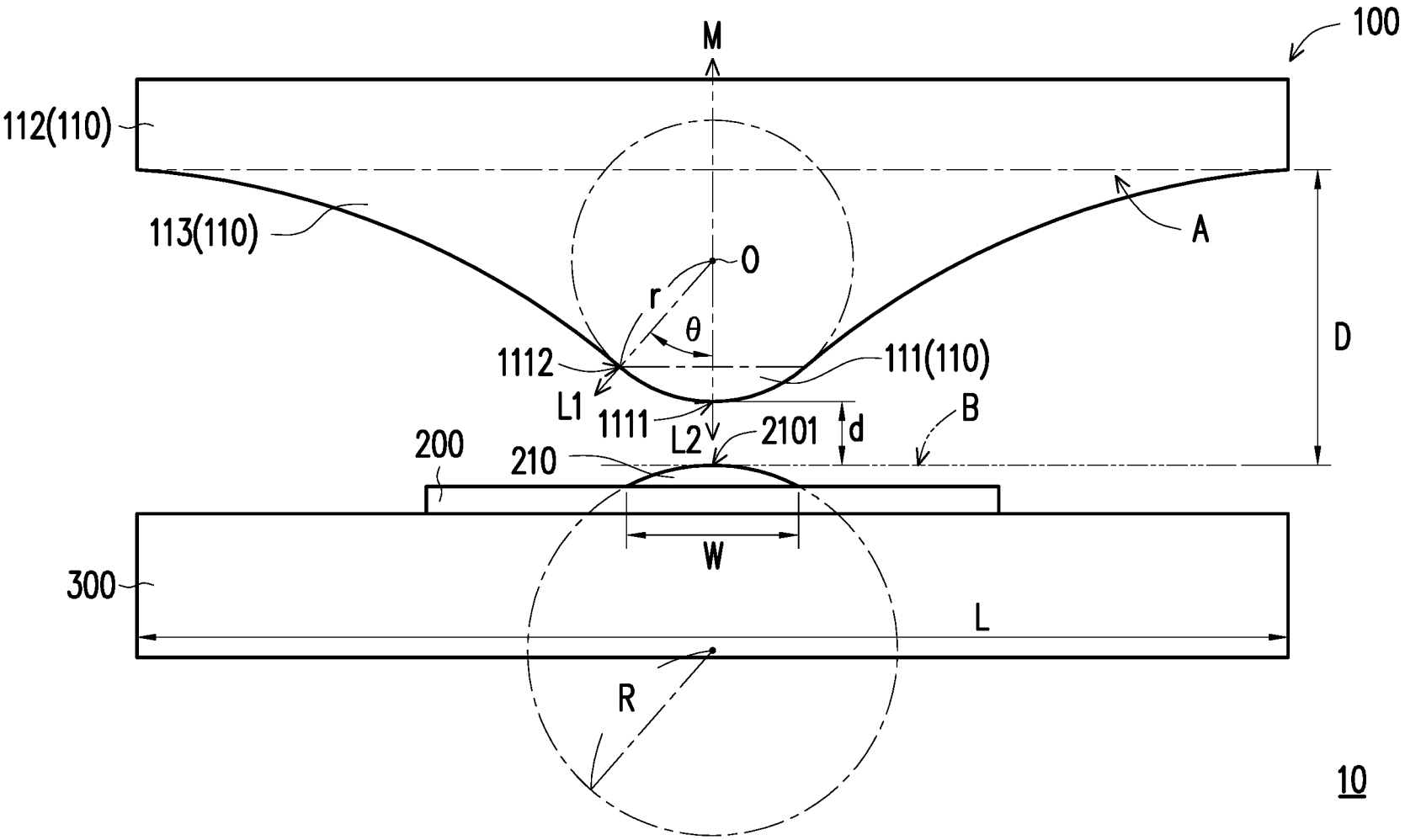
FIG. 3 is a schematic side view of a loudspeaker according to an embodiment of the disclosure.

FIG. 3 is a schematic side view of a loudspeaker 10 according to an embodiment of the disclosure. With reference to FIG. 3, the loudspeaker 10 of this embodiment includes the diffuser 100, a tweeter speaker 200, and a carrier 300. The tweeter speaker 200 has a spherical diaphragm 210, and a radius of curvature of the spherical diaphragm is R. The tweeter speaker 200 is, for example, a dome high-frequency unit or a general tweeter, and an audio frequency range of the tweeter speaker 200 is approximately 1,500 Hz (hertz) to 20,000 Hz. In general, the radius of curvature R of the spherical diaphragm 210 is approximately 20 mm (millimeter) to 27 mm. The tweeter speaker 200 is supported and carried by the carrier 300. Nevertheless, in other embodiments, the tweeter speaker 200 may not be required to be supported and carried by the carrier 300 and may be supported by other supporting mechanisms instead. The diffuser 100 is disposed above the tweeter speaker 200 and is separated from the tweeter speaker 200. Further, the diffuser 100 and the tweeter speaker 200 are at least separated by a distance d so that the diffuser 100 is not in contact with the tweeter speaker 200 in a process of which the loudspeaker 10 is operated. The diffuser 100 is formed by the cone body 110 including the apex portion 111, the bottom portion 112, and the side edge portion 113. The bottom portion 112 and the apex portion 111 are located at two opposite sides of the cone body 110. Further, the diffuser 100 is disposed in a way that the apex portion 111 is located between the bottom portion 112 and the tweeter speaker 200. That is, the apex portion 111 of the cone body 110 is disposed to face towards the tweeter speaker 200. The side edge portion 113 is aspherical and is connected between the apex portion 111 and the bottom portion 112. The apex portion 111 of the diffuser 100 forms a partial spherical surface, and the radius of curvature of the apex portion 111 is r. When r is greater than R, the diffuser 100 may strengthen diffusion of sound waves with a frequency of, for example, 1 KHz to 8 KHz; nevertheless, the diffusion effect provided by the diffuser 100 on sound waves with higher frequencies is unfavorable. When r is less than R, a reverse diffusion effect on sound waves is obtained. Therefore, in this embodiment, the radius of curvature r of the apex portion 111 may satisfy $2R/3 \geq r \geq R$, so as to increase the diffusion effect on the sound waves with higher frequencies.

The diffuser 100 of this embodiment is approximately identical to the diffuser 100 described in the embodiment of FIG. 1A to FIG. 1C, and thereby, previous contents may be referred to for the structural design of the diffuser 100, and that description of the structural design of the diffuser 100 is not repeated hereinafter. In the loudspeaker 10, the diffuser 100 featuring the foregoing characteristics may be disposed above the tweeter speaker 200, and in this way, a frequency response of a wave band with higher frequencies may be properly increased. As such, a response curve of the loudspeaker 10 is relatively flat, and response curves obtained in different directions can also be more identical, so that favorable sound quality is achieved.

To be specific, the loudspeaker 10 of this embodiment includes the diffuser 100 featuring a rotation symmetric structure. A symmetric axis of the diffuser 100 is a central axis M, and the central axis M is defined by, for example, connecting the apex 1111 of the apex portion 111 and the center of curvature O of the apex portion 111. The central axis M further extends and passes through a zenith 2101 of the spherical diaphragm 210 of the tweeter speaker 200, as such, the diffuser 100 is substantially aligned with the spherical diaphragm 210 of the tweeter speaker 200. In addition, a distance d between the apex 1111 of the diffuser 100 and the zenith 2101 of the spherical diaphragm 210 is less than or equal to 5 mm, and in this way, the diffuser 100 may provide a favorable sound diffusion effect. Further, the distance d is greater than or equal to 0.5 mm, in this way, vibration of the spherical diaphragm 210 is not affected in the operation process as the spherical diaphragm 210 of the tweeter speaker 200 is not in contact with the diffuser 100. Herein, the distance d between the apex 1111 of the diffuser 100 and the zenith 2101 of the spherical diaphragm 210 refers to a vertical distance between the apex 1111 and a tangential plane B of the zenith 2101 of the spherical diaphragm 210.

Specifically, a vertical distance D between the bottom portion 112 (or the highest point of the side edge portion 113) of the diffuser 100 and the zenith 2101 of the spherical diaphragm 210 of the tweeter speaker 200 is 20.5 mm (millimeter) to 45 mm. The vertical distance D between the bottom portion 112 and the zenith 2101 of the spherical diaphragm 210 of the tweeter speaker 200 is exemplified as a vertical distance between the plane A where the bottom portion 112 and the side edge portion 113 are connected and the zenith 2101 of the spherical diaphragm 210 in this embodiment. Response of high-frequency (e.g., greater than 8 KHz) sound waves may be increased by increasing the distance D. For instance, when the distance D increases, decrease of amplitude of high frequency sound waves in the response curve reduces. The volume of the diffuser 100 may increase when the distance D increases, so that the designer may determine the distance D corresponding to different needs. That is, a structure and a size of the diffuser 100 as well as the distance d between the diffuser 100 and the tweeter speaker 200 may be adjusted according to needs.

In some embodiments, in the diffuser 100, a first connection line L1 is defined by connecting a connection point 1112 between the apex portion 111 and the side edge portion 113 to the center of curvature O of the apex portion 111, and a second connection line L2 is defined by connecting the apex 1111 of the apex portion 111 to the center of curvature O of the apex portion 111. The diffuser 100 may be designed in a way that an included angle θ between the first connection line L1 and the second connection line L2 satisfies: $30° \geq \theta \geq 45°$. In a periphery of the connection point 1112, the slope of the side edge portion 113 with respect to the bottom portion 112 may be approximately 30° to 45°. Moreover, the slope of the side edge portion 113 of the diffuser 100 with respect to the bottom portion 112 of the diffuser 100 may decrease away from the apex portion 111. Nevertheless, along with different design needs, the slope of the side edge portion 113 with respect to the bottom portion 112 may selectively increase, maintain to be equal, or change segment by segment away from the apex portion 111.

Furthermore, the carrier 300 may be further disposed in the loudspeaker 10 of this embodiment, and the tweeter speaker 200 is installed on the carrier 300, and the carrier 300 exposes the spherical diaphragm 210 of the tweeter speaker 200. In some embodiments, a cross-sectional width of the carrier 300 is L, and a cross-sectional width of the spherical diaphragm 210 of the tweeter speaker 200 is W, and the cross-sectional width L may approximately be 4 times to 5 times greater than the cross-sectional width W, and a width of the diffuser 100 may be identical to or similar to a width of the carrier 300. For instance, a cross-sectional width of the bottom portion 112 of the cone body 110 of the diffuser 100 may also be 4 times to 5 times greater than the cross-sectional width W of the spherical diaphragm 210. In addition, a surface of the carrier 300 may be flat, but is not limited thereto.

Figure 4:
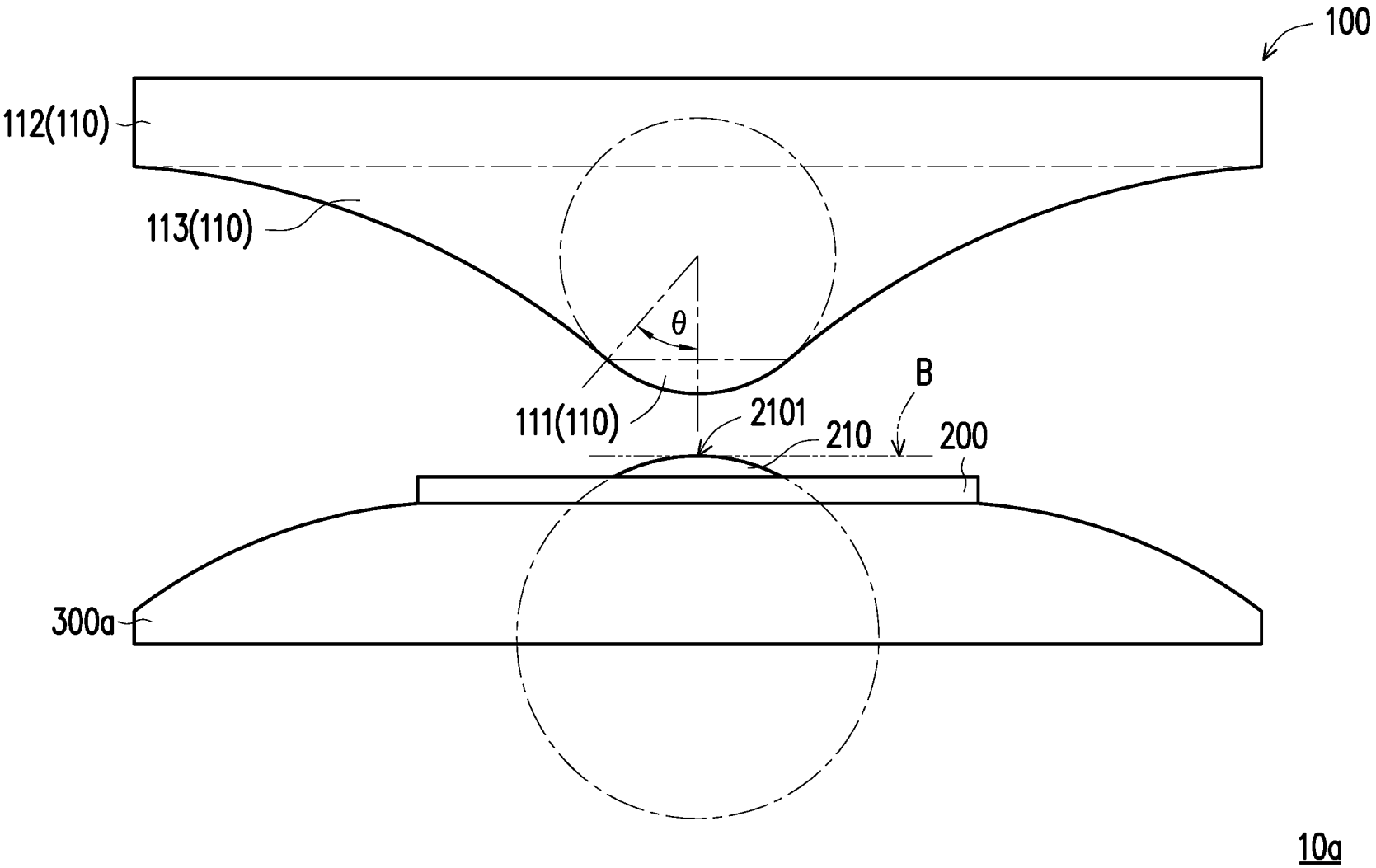
FIG. 4 is a schematic side view of a loudspeaker according to another embodiment of the disclosure.

FIG. 4 is a schematic side view of a loudspeaker 10*a* according to another embodiment of the disclosure. With reference to FIG. 4, the loudspeaker 10*a* of this embodiment includes the diffuser 100, the tweeter speaker 200, and a carrier 300*a*. The loudspeaker 10*a* of this embodiment is similar to the loudspeaker 10 of FIG. 3. Relative arrangement relations among and functions of the diffuser 100, the tweeter speaker 200, and the carrier 300*a* of FIG. 4 are approximately similar to the relative arrangement relations among and functions of the diffuser 100, the tweeter speaker 200, and the carrier 300 of FIG. 3. Nevertheless, a difference therebetween is that a surface of the carrier 300*a* is an arc surface, and the surface of the carrier 300*a* is further away from a tangential plane of the zenith 2101 of the spherical diaphragm 210 when being further away from the spherical diaphragm 210 of the tweeter speaker 200.

Figure 5:
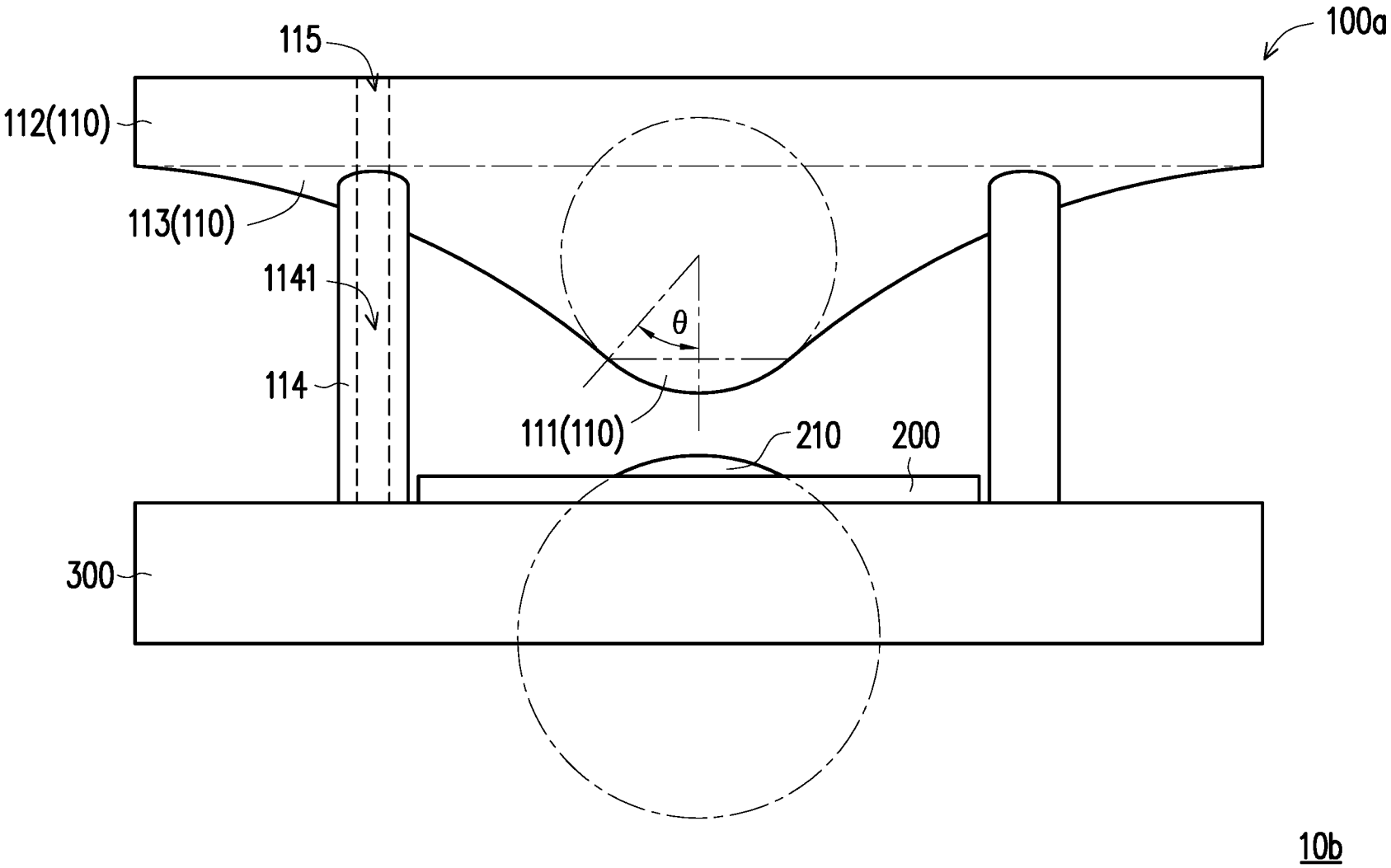
FIG. 5 is a schematic side view of a loudspeaker according to still another embodiment of the disclosure.

FIG. 5 is a schematic side view of a loudspeaker 10*b* according to still another embodiment of the disclosure. With reference to FIG. 5, the loudspeaker 10*b* of this embodiment is similar to the loudspeaker 10 of FIG. 3. The loudspeaker 10*b* of this embodiment includes a diffuser 100*a*, the tweeter speaker 200, and the carrier 300. The loudspeaker 10*b* of this embodiment is similar to the loudspeaker 10 of FIG. 3. Relative arrangement relations among and functions of the diffuser 100*a*, the tweeter speaker 200, and the carrier 300 of FIG. 5 are approximately similar to the relative arrangement relations among and functions of the diffuser 100, the tweeter speaker 200, and the carrier 300 of FIG. 3. Nevertheless, a difference therebetween is that the diffuser 100*a* of the loudspeaker 10*b* of this embodiment further includes at least one support pillar 114. That is, a structural design applied to the diffuser 100*a* of the loudspeaker 10*b* is approximately similar to that applied to the diffuser 100*a* of FIG. 2. Specifically, in the diffuser 100*a*, the support pillar 114 is inserted on the side edge portion 113 and protrudes and extends from the side edge portion 113 away from the bottom portion 112. In this way, the diffuser 100*a* may be conveniently disposed above the tweeter speaker 200. For instance, the support pillar 114 may be abutted against or inserted on the carrier 300 so that the cone body 110 of the diffuser 100*a* is fixed above the tweeter speaker 200.

From FIG. 5, it can be seen that the at least one support pillar 114 may include a first through hole 1141 penetrating the height of the at least one support pillar 114, and the cone body 110 may include a second through hole 115. Further, the first through hole 1141 and the second through hole 115 are connected, so as to provide a wiring space. A cross section of the first through hole 1141 may be designed to be teardrop-shaped, so that an electric wire may be conveniently inserted, but the disclosure is not limited thereto. In some embodiments, all of the support pillars 114 may be solid pillars without the first through hole 1141. In addition, a width of the support pillar 114 may be further designed to be less than ¼ of a wavelength of a 20 KHz sound wave. In this way, sound transmission is not affected by the support pillar 114, but the disclosure is not intended to limit the width of the support pillar 114. In this embodiment, an upper surface of the carrier 300 facing towards the diffuser 100*a* may be designed to be a plane. Nevertheless, in other embodiments, the surface of the carrier may also be designed to be an arc surface, such as the surface of the arc-shaped carrier 300*a* presented in FIG. 4, and the disclosure is not intended to limit the design of the surface of the carrier.

Figure 6:
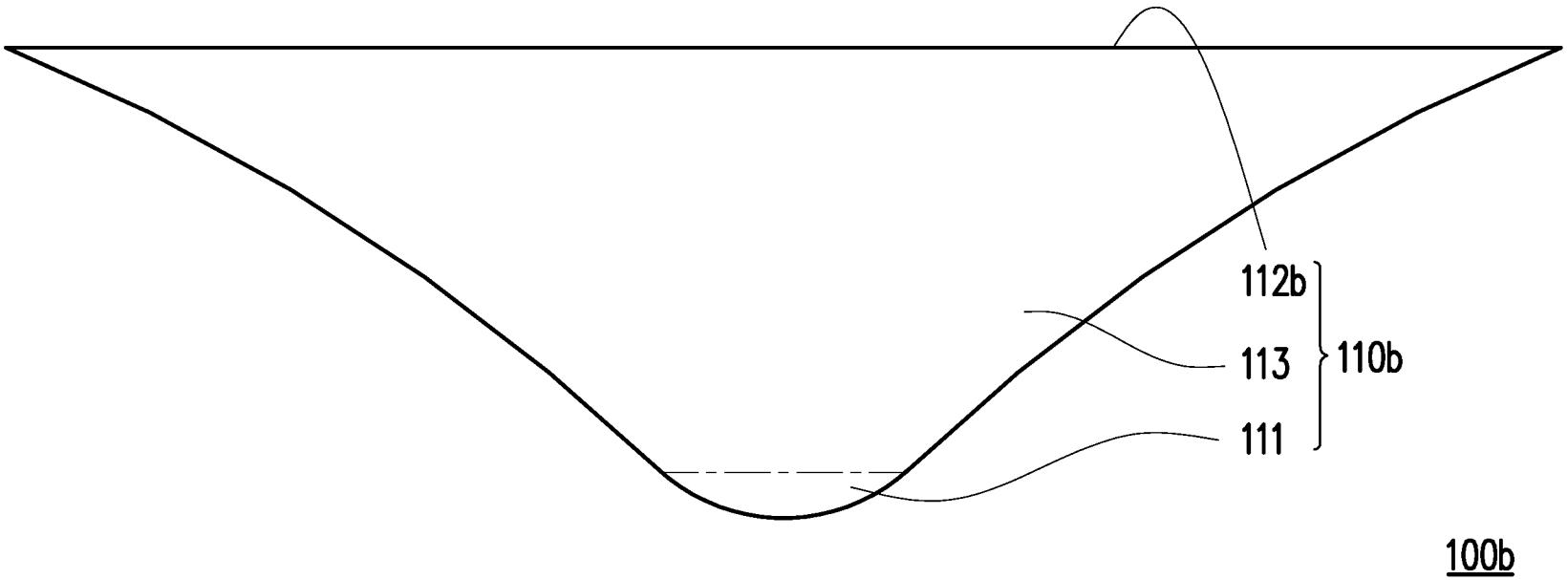
FIG. 6 is a schematic side view of a diffuser according to another embodiment of the disclosure.

FIG. 6 is a schematic side view of a diffuser 100*b* according to another embodiment of the disclosure. With reference to FIG. 6, the diffuser 100*b* of this embodiment is similar to the diffuser 100 of FIG. 1A to FIG. 1C, and a difference therebetween is that: a cone body 110*b* of the diffuser 100*b* is formed by the apex portion 111, a bottom portion 112*b*, and the side edge portion 113, and the bottom portion 112*b* is approximately formed by an area of a top end of the side edge portion 113. That is, a thickness of the bottom portion 112*b* is significantly less than that of the bottom portion 112 of the diffuser 100.

Figure 7:
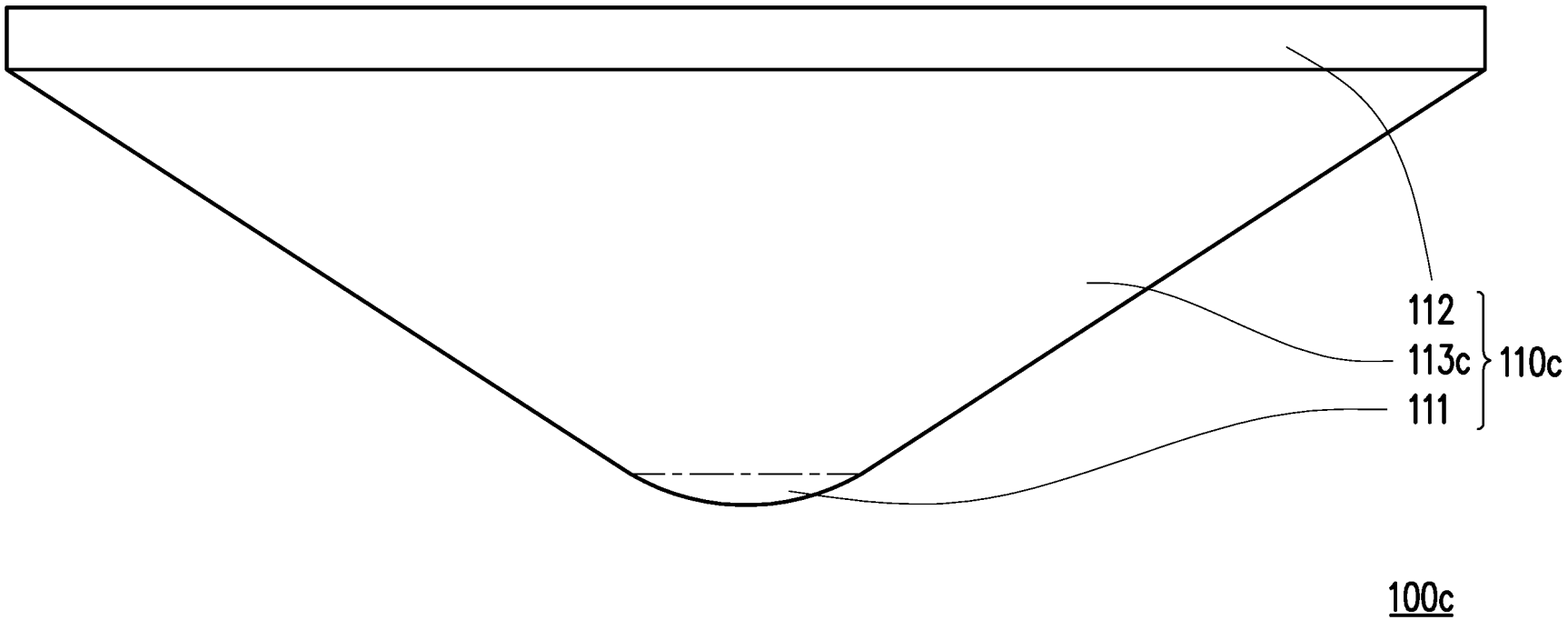
FIG. 7 is a schematic side view of a diffuser according to another embodiment of the disclosure.

FIG. 7 is a schematic side view of a diffuser 100*c* according to another embodiment of the disclosure. With reference to FIG. 7, a diffuser 100*c* of this embodiment is similar to the diffuser 100 of FIG. 1A to FIG. 1C, and a difference therebetween is that: a cone body 100*c* of the diffuser 100*c* is formed by the apex portion 111, the bottom portion 112, and a side edge portion 113*c*, and a slope of the side edge portion 113*c* is fixed. That is, a profile of the side edge portion 113*c* in the side view is formed by a straight line.

Figure 8:
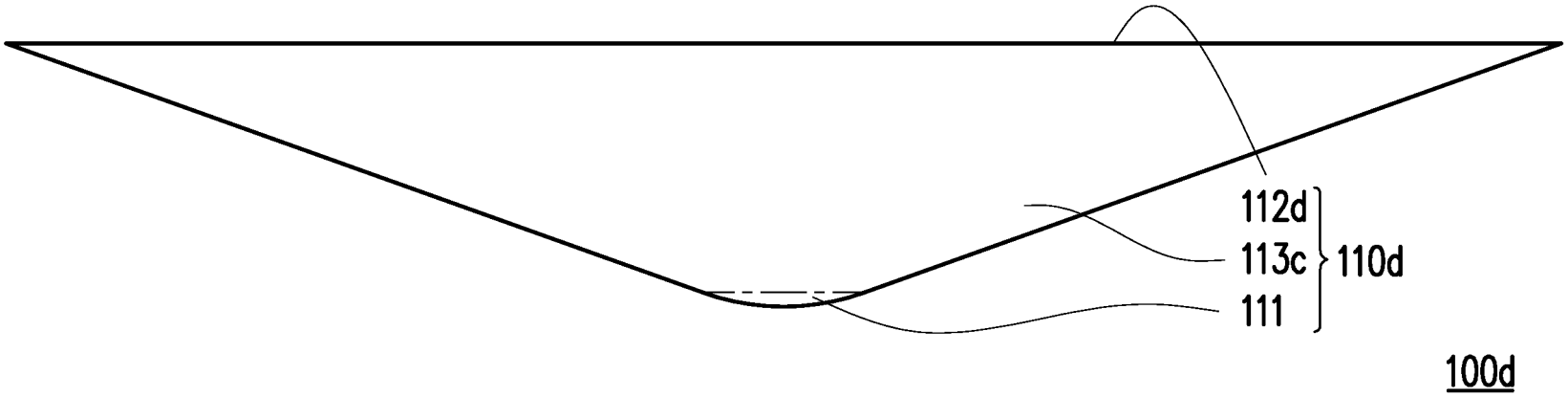
FIG. 8 is a schematic side view of a diffuser according to another embodiment of the disclosure.

FIG. 8 is a schematic side view of a diffuser 100*d* according to another embodiment of the disclosure. With reference to FIG. 8, the diffuser 100*d* of this embodiment is similar to the diffuser 100*c* of FIG. 7, and a difference therebetween is that: a cone body 110*d* of the diffuser 100*d* is formed by the apex portion 111, a bottom portion 112*d*, and the side edge portion 113*c*, and the bottom portion 112*d* is approximately formed by an area of a top end of the side edge portion 113*c*. That is, a thickness of the bottom portion 112*d* is significantly less than that of the bottom portion 112 of the diffuser 100*c*.

In view of the foregoing, the diffuser provided by the disclosure is formed at least by the cone body, and the cone body includes the apex portion, the bottom portion, and the side edge portion. The apex portion forms a partial spherical surface and satisfies: $2R/3 \geq r \geq R$, where r is the radius of curvature of the apex portion, and R is the radius of curvature of the spherical diaphragm of the tweeter speaker matched with the diffuser. With the diffuser, the frequency response of the wave band of higher frequencies may be properly increased, the response curve is relatively flat, and the response curves obtained in different directions can be more identical. Therefore, favorable sound quality is achieved, sound distortion is reduced, and sound transmission over a large area can be achieved with reduced costs and volume.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A diffuser, configured to be used with a tweeter speaker, the diffuser comprising:

a cone body, comprising:

an apex portion, the apex portion forming a partial spherical surface;

a bottom portion, the bottom portion and the apex portion being located at two opposite sides of the cone body; and a side edge portion, being aspherical, connected between the apex portion and the bottom portion;

wherein the apex portion satisfies:

$2R/3 \geq r \geq R$, wherein r is a radius of curvature of the apex portion, and R is a radius of curvature of a spherical diaphragm of the tweeter speaker.

2. The diffuser as claimed in claim 1, wherein a central axis is defined by connecting an apex of the apex portion to a center of curvature of the apex portion, and the central axis extends and passes through a geometric center of the bottom portion.

3. The diffuser as claimed in claim 1, wherein a distance between an apex of the apex portion and the bottom portion is 20 mm to 40 mm.

4. The diffuser as claimed in claim 1, wherein a first connection line is defined by connecting a connection point between the apex portion and the side edge portion to a center of curvature of the apex portion, a second connection line is defined by connecting an apex of the apex portion to the center of curvature of the apex portion, and an included angle θ between the first connection line and the second connection line satisfies: $30° \geq \theta \geq 45°$.

5. The diffuser as claimed in claim 1, wherein a slope of the side edge portion with respect to the bottom portion decreases away from the apex portion.

6. The diffuser as claimed in claim 1, further comprising at least one support pillar inserted on the side edge portion, the at least one support pillar protruding and extending from the side edge portion away from the bottom portion.

7. The diffuser as claimed in claim 6, wherein the at least one support pillar has a first through hole, the cone body has a second through hole, and the first through hole is connected to the second through hole.

8. The diffuser as claimed in claim 1, wherein the side edge portion forms an arc-shaped profile between the bottom portion and the apex portion, and a radius of curvature of the arc-shaped profile is 65% of a cross-sectional width of the bottom portion.

9. A loudspeaker, comprising:

a tweeter speaker, having a spherical diaphragm, a radius of curvature of the spherical diaphragm being R; and a diffuser, disposed above the tweeter speaker, separated from the tweeter speaker by a distance, the diffuser comprising:

a cone body, comprising:

an apex portion, facing towards the tweeter speaker, the apex portion forming a partial spherical surface, a radius of curvature of the apex portion being r, wherein $2R/3 \geq r \geq R$;

a bottom portion, the bottom portion and the apex portion being located at two opposite sides of the cone body; and a side edge portion, being aspherical, connected between the apex portion and the bottom portion.

10. The loudspeaker as claimed in claim 9, wherein a central axis is defined by connecting an apex of the apex portion to a center of curvature of the apex portion, and the central axis extends and passes through a zenith of the spherical diaphragm of the tweeter speaker.

11. The loudspeaker as claimed in claim 9, wherein a distance between an apex of the diffuser and a zenith of the spherical diaphragm is less than or equal to 5 mm and greater than or equal to 0.5 mm.

12. The loudspeaker as claimed in claim 9, wherein a vertical distance between the bottom portion of the cone body and a zenith of the spherical diaphragm of the tweeter speaker is 20.5 mm to 45 mm.

13. The loudspeaker as claimed in claim 9, wherein a first connection line is defined by connecting a connection point between the apex portion and the side edge portion to a center of curvature of the apex portion, a second connection line is defined by connecting an apex of the apex portion to the center of curvature of the apex portion, and an included angle $\theta$ between the first connection line and the second connection line satisfies: $30° \geq \theta \geq 45°$.

14. The loudspeaker as claimed in claim 9, wherein a slope of the side edge portion of the diffuser with respect to the bottom portion of the diffuser decreases away from the apex portion.

15. The loudspeaker as claimed in claim 9, wherein the diffuser further comprises at least one support pillar inserted on the side edge portion, the at least one support pillar protruding and extending from the side edge portion away from the bottom portion.

16. The loudspeaker as claimed in claim 15, wherein the at least one support pillar has a first through hole, the cone body has a second through hole, and the first through hole is connected to the second through hole.

17. The loudspeaker as claimed in claim 9, further comprising a carrier, the tweeter speaker being installed on the carrier, the carrier exposing the spherical diaphragm of the tweeter speaker.

18. The loudspeaker as claimed in claim 17, wherein a cross-sectional width of the carrier is 4 times to 5 times greater than a cross-sectional width of the spherical diaphragm of the tweeter speaker.

19. The loudspeaker as claimed in claim 17, wherein a surface of the carrier is an arc surface.

20. The loudspeaker as claimed in claim 19, wherein the surface of the carrier is further away from a tangential plane of a zenith of the spherical diaphragm when being further away from the spherical diaphragm of the tweeter speaker.

21. The loudspeaker as claimed in claim 9, wherein the side edge portion forms an arc-shaped profile between the bottom portion and the apex portion, and a radius of curvature of the arc-shaped profile is 65% of a cross-sectional width of the bottom portion.

* * * * *